US006801115B2

(12) United States Patent
Shikama et al.

(10) Patent No.: US 6,801,115 B2
(45) Date of Patent: Oct. 5, 2004

(54) BEAD INDUCTOR AND METHOD OF MANUFACTURING SAME

(75) Inventors: Takashi Shikama, Yokaichi (JP); Masami Sugitani, Omihachiman (JP); Hisato Oshima, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 4 days.

(21) Appl. No.: 10/076,394

(22) Filed: Feb. 19, 2002

(65) Prior Publication Data

US 2002/0075112 A1 Jun. 20, 2002

Related U.S. Application Data

(62) Division of application No. 09/337,988, filed on Jun. 22, 1999, now Pat. No. 6,377,152.

(30) Foreign Application Priority Data

Jun. 23, 1998 (JP) ..... 10-175650

(51) Int. Cl.[7] ..... H01F 5/00

(52) U.S. Cl. ..... 336/200; 336/83; 336/192; 29/602.1

(58) Field of Search ..... 336/65, 83, 90, 336/96, 192, 199, 200, 220, 221, 232, 233; 29/602.1

(56) References Cited

FOREIGN PATENT DOCUMENTS

| | | |
|---|---|---|
| JP | 61-214405 A | 9/1986 |
| JP | 1-253906 A | 10/1989 |
| JP | 3-106708 | 11/1991 |

*Primary Examiner*—Tuyen T. Nguyen
(74) *Attorney, Agent, or Firm*—Keating & Bennett, LLP

(57) ABSTRACT

A bead inductor has excellent productivity and increased reliability in the connection between an internal conductor and external terminals. A method for manufacturing such a bead inductor includes the steps of forming an internal conductor and the external terminals as an integral, unitary member such that the external terminals are disposed at both ends of the internal conductor and electrically connected thereto; positioning the integral, unitary member in a metallic mold; and molding a resin material or a rubber material including a powdered magnetic substance in the metallic mold so as to embed the internal conductor therein.

8 Claims, 5 Drawing Sheets

BEAD INDUCTOR AND METHOD OF MANUFACTURING SAME

This application is a Divisional of U.S. patent application Ser. No. 09/337,988 filed Jun. 22, 1999, now U.S. Pat. No. 6,377,152.

BACKGROUND OF THE INVENTION

1. Field of the Invention

The present invention relates to a method of manufacturing a bead inductor for use in a noise controlling device or other electronic device.

2. Description of the Related Art

As a noise controlling device, especially a device for use with a microprocessor, for example, which is required to pass a large electric current therethrough, an experimental bead inductor has been proposed and tested. Such a bead inductor is an example of an experimental device which has not been publicly disclosed and is formed of a resin material or a rubber material including a powdery magnetic substance such as ferrite powder having a conductor coil embedded therein. In such a bead inductor, a conductor coil is embedded into a resin material or a rubber material via injection molding or other process, to form a molded body which is cut off at both ends thereof to expose both ends of the coil disposed therein. Then, metal caps are connected thereto via conductive resin paste or spot welding so as to define external terminals.

FIGS. 12 and 13 are sectional views illustrating a method for manufacturing a conventional bead inductor. Referring to FIG. 12, a metallic mold for injection molding to manufacture the bead inductor includes an upper mold 1 and a lower mold 2. A cavity 3 is formed in the upper mold 1 and defines a space for molding a resin. In the lower mold 2, a pin 4 is provided so as to be disposed in the cavity 3 when the upper mold 1 and the lower mold 2 are mated with each other. The upper mold 1 has a gate 1*a* for supplying a molten resin into the cavity 3.

In order to manufacture the conventional bead inductor using the metallic mold shown in FIG. 12, the pin 4 is inserted into a coreless coil defining an internal conductor. Then, the molten resin including a powdered magnetic substance such as ferrite powder is injected into the cavity 3 from the gate 1*a*. Thereby, the outer portion of the coil inserted by the pin 4 therein is molded.

FIG. 13 is a sectional view showing an outer resin portion 8*a* of the coil 5 molded in this manner. Then, the pin 4 is removed and the same resin as the outer portion of the coil 5 is injected into the space formed when the pin is removed, to mold the inner portion of the coil 5.

Both end portions of the molded body obtained in this manner are cut off by a dicing saw or other cutting device, such that both end portions of the coil are exposed. Metallic caps are attached to both end portions of the molded body so as to electrically connected to the exposed both end portions of the coil by conductive resin paste, spot welding, or the like.

FIGS. 14 and 15 are a side view and a plan view, respectively, showing an example of conventional bead inductors obtained as described above. As shown in FIGS. 14 and 15, in a conventional bead inductor, the coil 5 is embedded in a molded resin portion 8 and metallic caps 6 and 7 are attached to both end portions of the coil 5. The metallic caps 6 and 7 are electrically connected to both end portions of the coil 5 and used as external terminals.

As mentioned above, in a conventional method for manufacturing a bead inductor, after the coil defining an internal conductor is embedded in a resin material or other suitable material by injection molding, etc., it has been required that a molded body is machined or ground so as to expose both end portions of the internal conductor. It has been also required that the internal conductor and external terminals such as metallic caps are electrically connected by soldering, welding, conductive adhesives, etc. Since a break or degradation in contact is prone to occur in the electrical connection achieved by soldering, conductive adhesives, etc., there has been also a problem of a low degree of reliability of the connection.

SUMMARY OF THE INVENTION

To overcome the problems described above, preferred embodiments of the present invention provide a method of manufacturing a bead inductor to achieve increased productivity and greatly improved connection reliability between the internal conductor and the external terminals.

In accordance with a preferred embodiment of the present invention, a method for manufacturing a bead inductor includes the steps of forming an integral unitary member including an internal conductor and external terminals, the external terminals disposed at both ends of the internal conductor being electrically connected thereto; positioning the integral unitary member in a metallic mold; and molding at least one of a resin material and a rubber material including a powdered magnetic substance in the metallic mold so as to embed the internal conductor therein.

According to the one preferred embodiment of the present invention, because the integral unitary member including the internal conductor and the external terminals is used, the internal conductor and the external terminals are electrically connected in advance. Therefore, the step of exposing both end portions of the internal conductor so as to electrically connect the external terminals thereto is not required. Because the internal conductor and the external terminals are unitized in advance, connection reliability is greatly increased compared with a conventional method.

In accordance with preferred embodiments of the present invention, a through-hole for supplying at least one of the resin material and the rubber material in the periphery of the internal conductor in the metallic mold may be formed in either one or both of the external terminals. Molten resin or the like can be supplied from the outside of the external terminals in the cavity for injection molding, etc., by forming the through-hole in either one or both of the external terminals. Therefore, the metallic mold can be easily and readily designed. Dimensions and a shape of the cavity in the metallic mold can be established so as to conform to the dimensions and shape of the integral unitary member of the internal conductor and the external terminals, resulting in minimizing the amount of the resin or other suitable material being used for covering the periphery of the internal conductor and for embedding the internal conductor deposits on the external terminals.

The integral unitary member including the internal conductor and the external terminals according to preferred embodiments of the present invention may be unitarily formed by processing a metallic plate. For example, the unitary integral member including the pair of the external terminals disposed at both ends of the internal conductor can be formed by blanking a metallic plate and bending it.

The unitary integral member of the internal conductor and the external terminals according to preferred embodiments of the present invention may be formed by a simple process.

The unitary integral member including the internal conductor and the external terminals according to preferred embodiments of the present invention may be formed by unitizing separately formed internal conductor and external terminals. Therefore, the integral unitary member in which either the internal conductor or the external terminals which may have been previously difficult to form by working a metallic plate can be easily formed in preferred embodiments of the present invention. For example, the unitary integral member having a coil-shaped internal conductor can be formed according to preferred embodiments of the present invention. As for the process of forming the unitary integral member including the internal conductor and the external terminals, welding, soldering, adhesion by conductive adhesives, and other suitable methods may be used.

The internal conductor and the external terminals according to preferred embodiments of the present invention may be unitized via welding.

The strength and reliability of connection of the internal conductor to the external terminals is greatly increased via the welding.

The internal conductor according to preferred embodiments of the present invention may be coil-shaped. The length of the internal conductor can be elongated by using the coil-shaped internal conductor so that an inductance thereof is readily and easily adjustable.

In accordance with another preferred embodiment of the present invention, a bead inductor includes an internal conductor, a molded member having at least one of a resin material and a rubber material including a powdered magnetic substance with the internal conductor embedded therein, and external terminals disposed at both ends of the internal conductor and being electrically connected thereto, wherein the internal conductor and the external terminals define a pre-formed integral, unitary member.

In a bead inductor according to this other preferred embodiment of the present invention, since the internal conductor and the external terminals are arranged to define a pre-formed integral, unitary member, the manufacturing process thereof is substantially simplified and efficiency of production thereof is greatly increased. Since the internal conductor and the external terminals are arranged to be pre-formed to define an integral, unitary member in advance, connection reliability is also increased as compared with a conventional device.

The internal conductor and the external terminals according to the another preferred embodiment of the present invention may be unitarily joined to define an integral member by processing a metallic plate.

In this case, since the internal conductor and the external terminals are simultaneously unitarily formed by processing a metallic plate, the manufacturing process thereof is greatly simplified and efficiency of production thereof is significantly increased.

The internal conductor and the external terminals according to the another preferred embodiment of the present invention may be unitarily formed to define the integral, unitary member, via welding the internal conductor and the external terminals which are separately formed in advance.

In this case, since the internal conductor and the external terminals are unitized via welding, the strength and reliability of the connection between the internal conductor and the external terminals is greatly increased, resulting in a significantly increased connection reliability.

The internal conductor according to the another preferred embodiment of the present invention may be coil-shaped. The length of the internal conductor can be elongated by using the coil-shaped internal conductor so that an inductance thereof is readily and easily adjustable.

Other features and advantages of the present invention will become apparent from the following description of preferred embodiments of the present invention which refers to the accompanying drawings.

DETAILED DESCRIPTION OF PREFERRED EMBODIMENTS

Figure 2:
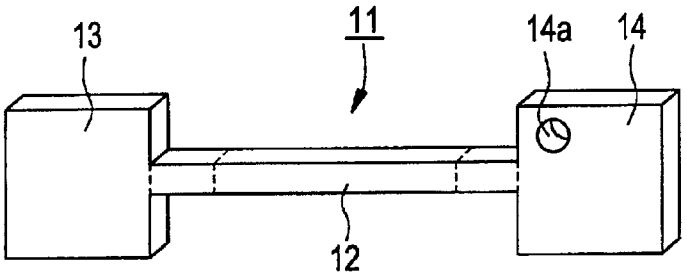
FIG. 2 is a schematic view of a piece of a metallic plate used for forming an integral, unitary member including an internal conductor and external terminals according to a preferred embodiment of the present invention.

FIG. 2 is a schematic view of a piece of a metallic plate for use in forming an integral, unitary member including an internal conductor and external terminals used in a preferred embodiment of the present invention. The piece of a metallic plate 11 shown in FIG. 2 can be formed, for example, by stamping a metallic plate. As for the metallic plate, as long as it has conductivity capable of use as terminals and excellent workability, it is not particularly limited and a copper plate, for example, can be used. In this preferred embodiment, the piece of a metallic plate is formed by blanking a copper plate.

The piece of a metallic plate 11 is preferably formed of a bar-shaped internal conductor 12 and substantially rectangular-shaped first and second external terminals 13 and 14 disposed at both end portions of the internal conductor 12. In the second external terminal 14, a through-hole 14*a* is formed as shown in the drawing.

Figure 3:
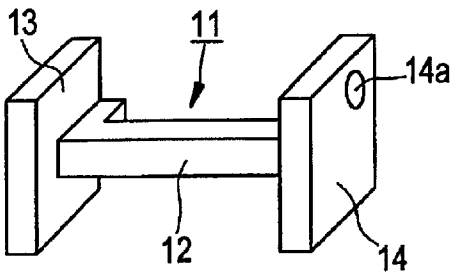
FIG. 3 is a schematic view showing an integral, unitary member including an internal conductor and external terminals according to a preferred embodiment of the present invention.

FIG. 3 is a schematic view showing the integral, unitary member including the internal conductor and the external terminals formed by bending the piece of a metallic plate shown in FIG. 2. In the piece of a metallic plate 11 shown in FIG. 2, the integral, unitary member as shown in FIG. 3 can be formed by bending portions shown by dotted lines. On both ends of the internal conductor 12, the external terminals 13 and 14 are disposed, respectively. The external terminals 13 and 14 are disposed so as to be opposite each other. In addition, for reinforcement of bent portions, spot welding, or other suitable processing may be performed on the bent portions, as occasion demands.

Figure 1:
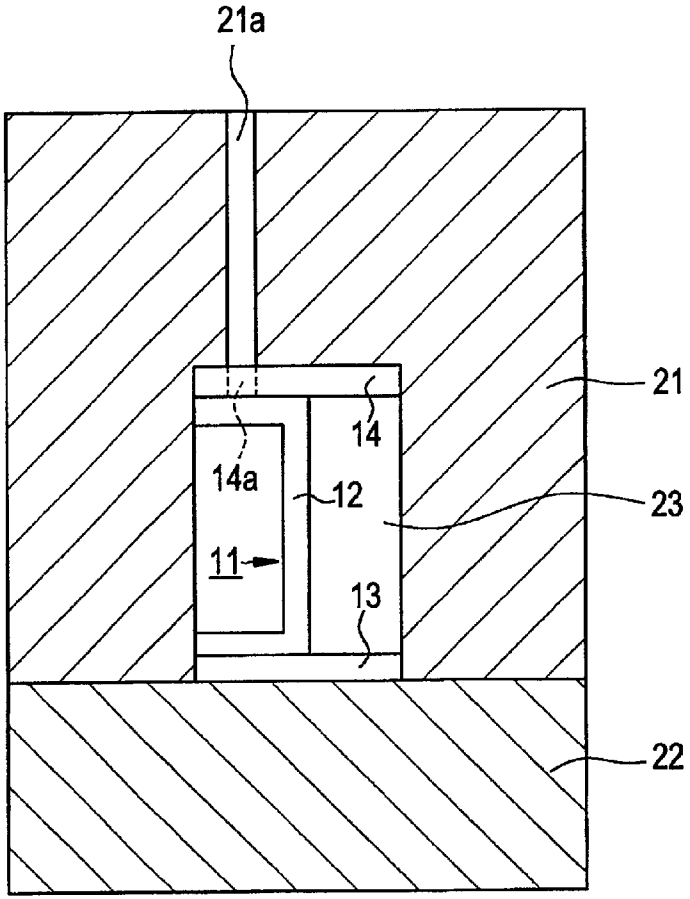
FIG. 1 is a sectional view for illustrating a method of manufacturing a bead inductor according to a preferred embodiment of the present invention.

FIG. 1 is a sectional view illustrating a method of manufacturing a bead inductor according to preferred embodiments of the present invention by using the integral, unitary member of the internal conductor and the external terminals shown in FIG. 3. As shown in FIG. 1, the integral, unitary member 11 is disposed inside of a cavity 23 in a metallic mold including an upper mold 21 and a lower mold 22. The cavity 23 is formed within the upper mold 21 and has a shape arranged to conform to that of the integral, unitary member 11. In the upper mold 21, a gate 21*a* for supplying molten resin into the cavity 23 is formed. When injection molding is performed, molten resin is supplied into the cavity 23 through the gate 21*a*. The integral unitary member 11 is disposed such that the second external terminal 14 is in contact with the top surface of the cavity 23 of the upper mold 21. The through-hole 14*a* of the external terminal 14 is formed so as to conform to the position of the gate 21*a* when being disposed in the cavity 23.

As shown in FIG. 1, in a state that the integral, unitary member 11 is disposed in the cavity 23, a molten resin is injected into the cavity 23 through the gate 21*a* so as to be poured around the internal conductor 12 for molding therearound. As for the molten resin, a resin including a powdered magnetic substance such as ferrite powder is preferably used. A content of the powdered magnetic substance is approximately 80% to 90% by weight, for example. As for the resin, a PPS (polyphenylene sulphide) resin or other suitable material is used.

As shown in FIG. 1, the through-hole 14*a* is preferably formed at the position in the second external terminal 14 corresponding to that of the gate 21*a*. Therefore, the molten resin supplied through the gate 21*a* is poured via the through-hole 14*a* around the internal conductor 12 formed between the pair of external terminals 13 and 14 such that the periphery of the internal conductor 12 is molded with the conductor 12 embedded therein.

Since the dimensions and a shape of the cavity 23 are configured to conform to the dimensions and shape of the integral, unitary member 11 as described above, the first external terminal 13 and the second external terminal 14 are positioned at the bottom end and the top end of the cavity 23, respectively. Accordingly, when the molten resin is poured into the cavity 23 for molding therearound, a large amount of molten resin is not added on the external terminals 13 and 14 to be coated thereon.

After the resin molding is performed with the internal conductor 12 embedded therein in the manner mentioned above, a molded body is taken out for barrel grinding treatment. Although a large amount of resin is not added on the external terminals 13 and 14 as described above, some amount of resin added thereon can be removed via the barrel grinding treatment.

In the preferred embodiment shown in FIG. 3, the through-hole 14*a* is formed only in the second external terminal 14. Another through-hole may-be formed in the first external terminal 13 at a similar position. By forming through-holes in both external terminals, the injection molding can be performed even if any of the external terminals is positioned upward.

Figure 4:
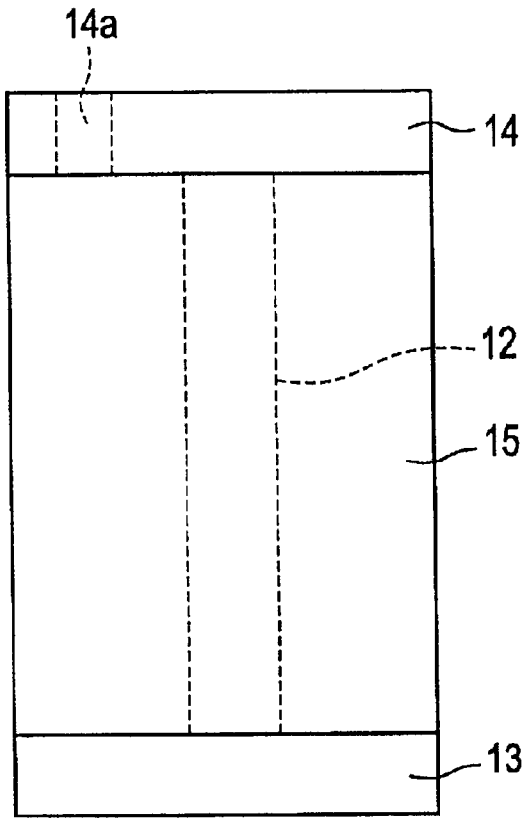
FIG. 4 is a side view of a bead inductor according to a preferred embodiment of the present invention.
Figure 5:
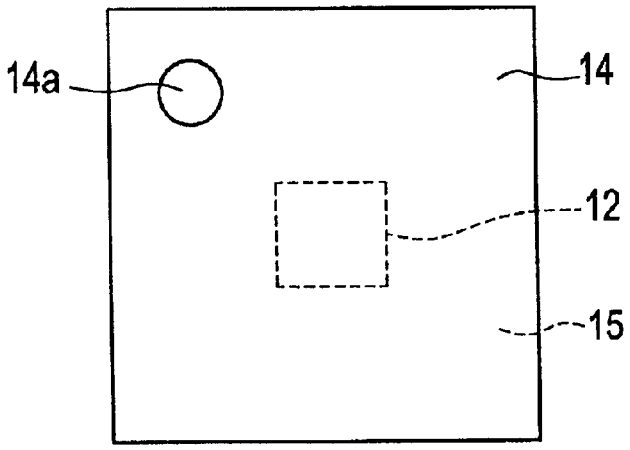
FIG. 5 is a plan view of a bead inductor according to a preferred embodiment of the present invention.

FIGS. 4 and 5 are a side view and a plan view of a bead inductor obtained as described above, respectively. As shown in FIGS. 4 and 5, a resin portion 15 including ferrite powder or other suitable material is formed around the internal conductor 12 formed between the external terminals 13 and 14. The internal conductor 12 is embedded in the resin portion 15. Since the external terminals 13 and 14 are disposed on both ends of the internal conductor 12 that are electrically connected therebetween in advance, the conventional process of attaching metallic caps, etc., to the molded body is not required. Solder may be added on the external terminals 13 and 14 to promote solderability as occasion demands.

In accordance with preferred embodiments of the present invention, as described above, machining or grinding for exposing terminal portions of the internal conductor is not required after injection molding. Because the molded body has external terminals provided in advance, an attaching process of metallic caps, etc., is not also required. The internal conductor 12 and the external terminals 13 and 14 are electrically connected therebetween in advance, resulting in greatly increased connecting reliability.

Figure 6:
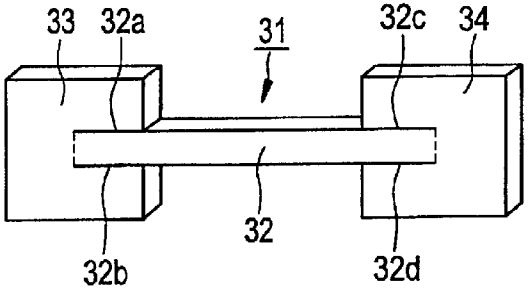
FIG. 6 is a schematic view of a piece of a metallic plate used for forming an integral, unitary member including an internal conductor and external terminals according to another preferred embodiment of the present invention.
Figure 7:
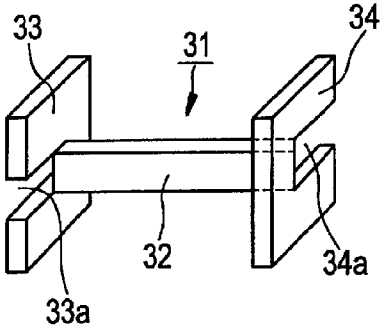
FIG. 7 is a schematic view showing an integral, unitary member including an internal conductor and external terminals according to another preferred embodiment of the present invention.

FIGS. 6 and 7 are schematic views for illustrating another preferred embodiment in which an integral, unitary member is formed in one single, integrated piece by processing a metallic plate.

FIG. 6 shows a piece of metallic plate obtained by blanking a metallic plate. In the piece of metallic plate 31 shown in FIG. 6, first and second external terminals 33 and 34 are formed at both end portions of an internal conductor 32. In the first external terminal 33, cuttings 32*a* and 32*b* are formed toward the vicinity of the center of the terminal, and the first external terminal 33 is formed so that one end of the internal conductor 32 is positioned at the approximate center of the first external terminal 33. Likewise, in the second external terminal 34, cuttings 32*c* and 32*d* are formed toward the vicinity of the center of the terminal, and the second external terminal 34 is formed so that another end of the internal conductor 32 is positioned at the approximate center of the second external terminal 34.

FIG. 7 shows an integral, unitary member including the internal conductor 32 and the external terminals 33 and 34 obtained by bending the piece of metallic plate shown in FIG. 6. As shown in FIG. 7, the first and second external terminals 33 and 34 are bent so as to be substantially perpendicular to the axis of the internal conductor 32 and are bent such that the first and second external terminals 33 and 34 are disposed opposite each other. Like the integral, unitary member 11 shown in FIG. 3, this integral, unitary member 31 is positioned in the cavity 23 of the metallic mold including the upper mold 21 and the lower mold 22 shown in FIG. 1. Like the above-described preferred embodiment, a bead inductor can be manufactured by forming a resin molded body with the internal conductor 32 embedded therein by means of injection molding of molten resin.

In the preferred embodiment shown in FIG. 7, notched portions 33*a* and 34*a* are formed in the external terminals 33 and 34, respectively, as shown in FIG. 7 by bending the internal conductor 32 and the external terminals 33 and 34. Therefore, the through-hole 14*a* shown in FIG. 3 is not required in this preferred embodiment. Molten resin can be supplied into the cavity through the notched portions 33*a* and 34*a*. In this case, the gate of the mold is disposed so as to correspond to the positions of the notching portions 33*a* and 34*a*.

Figure 8:
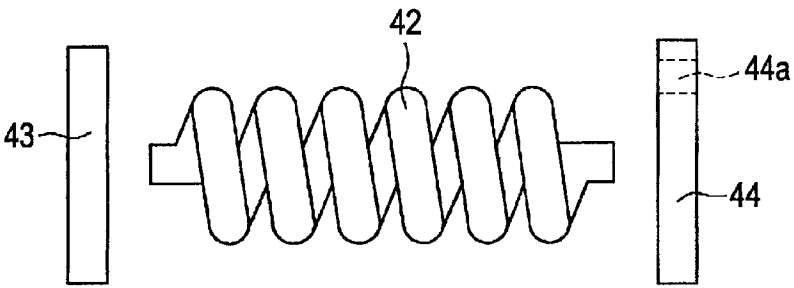
FIG. 8 is a side view showing an internal conductor and external terminals which are separately formed and then used for forming an integral, unitary member including an internal conductor and external terminals according to another preferred embodiment of the present invention.
Figure 9:
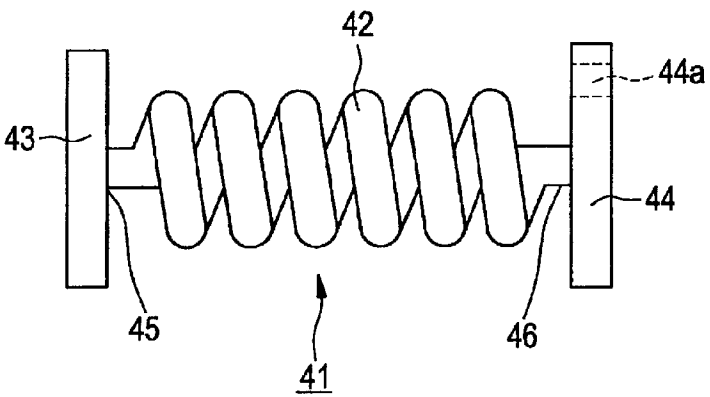
FIG. 9 is a side view showing the integral, unitary member including the internal conductor and external terminals according to another preferred embodiment of the present invention.

FIGS. 8 and 9 are side views for illustrating still another preferred embodiment of the present invention. In the preferred embodiment shown in FIGS. 8 and 9, an integral, unitary member including an internal conductor and external terminals is formed by unitizing the internal conductor and the external terminals which are separately formed.

Referring to FIG. 8, the internal conductor 42 and the external terminals 43 and 44 are respectively separately formed. As the internal conductor 42, a coil formed by a coated copper wire is used, for example. As the external terminals 43 and 44, a piece of substantially rectangular-shaped metallic plate formed by a copper plate, etc. is used, for example. In the external terminal 44, a through-hole 44*a* is formed like the preferred embodiment shown in FIGS. 2 and 3.

FIG. 9 is a side view showing an integral, unitary member formed by unitizing the internal conductor 42 and external terminals 43 and 44 shown in FIG. 8 via welding. As shown in FIG. 9, one end of the internal conductor 42 and the external terminal 43 are welded to each other at a welding portion 45, while another end of the internal conductor 42 and the external terminal 44 are welded to each other at a welding portion 46, such that the integral, unitary member of the internal conductor 42 and the external terminals 43 and 44 is formed. The integral, unitary member obtained in this manner is positioned in the cavity 23 shown in FIG. 1, and a resin including ferrite powder, etc. is injected in the periphery of the internal conductor 42 by injection molding so as to embed the internal conductor 42 in a resin molded body, as described above, so that a bead inductor can be manufactured.

Figure 11:
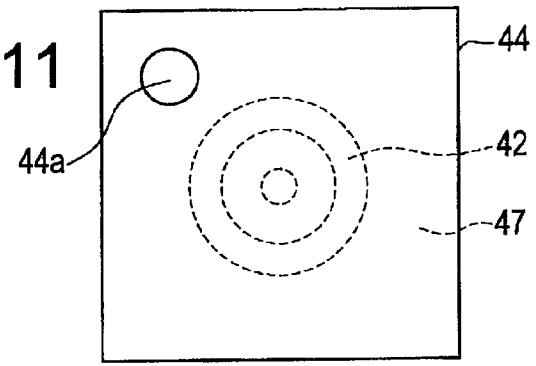
FIG. 11 is a plan view of the bead inductor according to still another preferred embodiment of the present invention.
Figure 12:
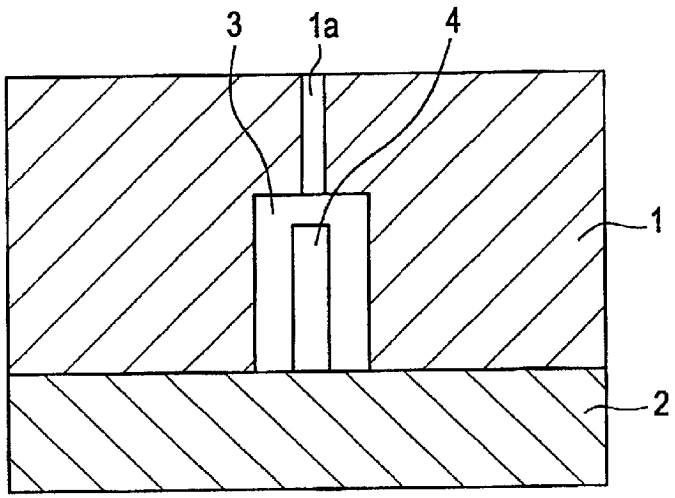
FIG. 12 PRIOR ART
FIG. 12 is a sectional view of a metallic mold for manufacturing a conventional bead inductor.
Figure 10:
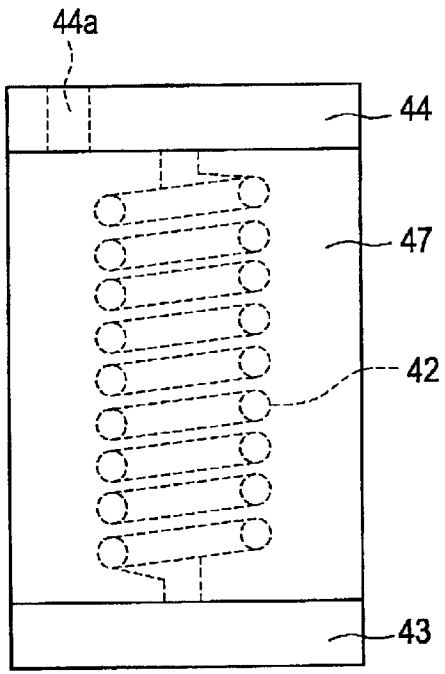
FIG. 10 is a side view of a bead inductor according to still another preferred embodiment of the present invention.
Figure 14:
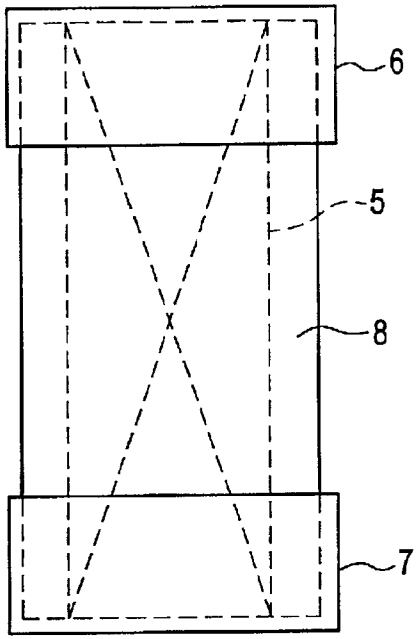
FIG. 14 PRIOR ART
FIG. 14 is a side view showing an example of conventional bead inductors.
Figure 15:
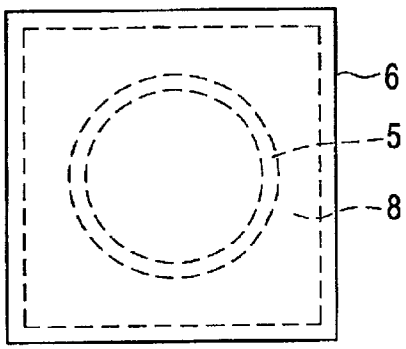
FIG. 15 PRIOR ART
FIG. 15 is a plan view showing the example of conventional bead inductors.
Figure 13:
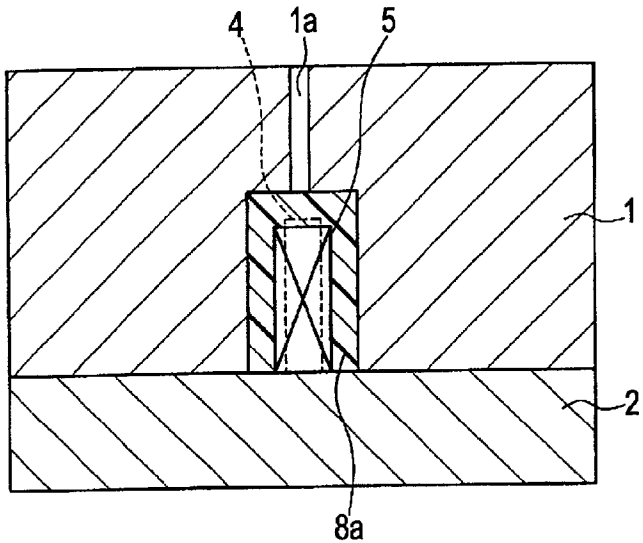
FIG. 13 PRIOR ART
FIG. 13 is a sectional view for illustrating a method for manufacturing a conventional bead inductor.

FIGS. 10 and 11 are a side view and a plan view of a bead inductor obtained in this manner according to this preferred embodiment, respectively. As shown in FIGS. 10 and 11, the resin molded body 47 is formed in the periphery of the internal conductor 42 formed between the external terminals 43 and 44 so as to embed the internal conductor 42 therein. Since the external terminals 43 and 44 are arranged in an exposed state in advance, metallic caps, etc. are not required to be further attached. The external terminals 43 and 44 can be used as terminals for connection to a circuit.

In this preferred embodiment, since the internal conductor and the external terminals are separately formed and then unitized together to define the integral, unitary member, a coil-shaped internal conductor can be used.

In the above-described preferred embodiment, the internal conductor and the external terminals are unitized via welding. However, the present invention is not limited to the welding and the internal conductor and external terminals may be unitized by other methods such as soldering and adhesion via conductive adhesives. The through-hole 44*a* is formed only in the terminal 44, however, a similar through-hole may be further formed also in the external terminal 43.

According to preferred embodiments of the present invention, the treatment by machining or grinding for exposing the internal conductor after forming a resin or a rubber is not required. The process of attaching the external terminals such as metallic caps to the internal conductor to be electrically connected is also not required. Therefore, the manufacturing process of preferred embodiments of the present invention is greatly simplified and efficiency of production is greatly increased. Since the integral, unitary member including the internal conductor and the external terminals is used, connection reliability between the internal conductor and the external terminals is greatly increased.

In accordance with preferred embodiments of the present invention, since the resin material or the rubber material may be supplied in the periphery of the internal conductor in the metallic mold by using a through-hole formed in the external terminal, the metallic mold can be readily designed and the resin material or the rubber material can be readily molded.

The integral, unitary member including the internal conductor and the external terminals according to preferred embodiments of the present invention may be simply formed.

In accordance with preferred embodiments of the present invention, since the internal conductor and the external terminals may be separately formed and then unitized together to define the integral, unitary member, the internal conductor and the external terminals can be designed in various shapes and, for example, a coil-shaped internal conductor can be used as the internal conductor.

In a bead inductor according to preferred embodiments of the present invention, since the internal conductor and the external terminals are unitized in advance, the process of attaching external terminals such as metallic caps to the internal conductor to be electrically connected thereto is not required, such that the manufacturing process thereof is greatly simplified and efficiency of production thereof is greatly increased. The connection reliability between the internal conductor and the external terminals is also greatly increased.

The bead inductor according to preferred embodiments of the present invention is adapted to be manufactured by a simplified process, and moreover has increased connection reliability between the internal conductor and the external terminals.

In a bead inductor according to preferred embodiments of the present invention, the strength and reliability of connection between the internal conductor and the external terminals is greatly increased, resulting in increased connection reliability.

In a bead inductor according to preferred embodiments of the present invention, the length of the internal conductor may be elongated so that an inductance thereof is readily and easily adjustable.

While the invention has been particularly shown and described with reference to preferred embodiments thereof, it will be understood by those skilled in the art that the forgoing and other changes in form and details may be made therein without departing from the spirit of the invention.

What is claimed is:

1. A bead inductor comprising:

an internal conductor;

a molded member of at least one of a resin material and a rubber material including a powdered magnetic substance with said internal conductor embedded therein; and external terminals disposed at both ends of said internal conductor and electrically connected thereto; wherein said internal conductor and said external terminals define a previously formed, integral, unitary member; and a through-hole for supplying at east one of the resin material and the rubber material in a periphery of the internal conductor in the molded member is formed in at least one of the external terminals.

2. A bead inductor according to claim 1, wherein said internal conductor and said external terminals are made of a metallic plate.

3. A bead inductor according to claim 1 wherein said integral, unitary member includes said internal conductor and said external terminals which are welded to each other.

4. A bead inductor according to claim 1, wherein said internal conductor is coil-shaped.

5. A bead inductor according to claim 1, wherein said internal conductor is bar-shaped.

6. A bead inductor according to claim 1, wherein said external terminals are substantially rectangular-shaped.

7. A bead inductor according to claim 1, wherein the internal conductor and the external terminals are welded to each other.

8. A bead inductor according to claim 1, wherein the internal conductor and the external terminals are soldered to each other.

* * * * *